US006145954A

United States Patent [19]

Moore

[11] Patent Number: 6,145,954

[45] Date of Patent: Nov. 14, 2000

[54] INK JET PRINTER

[75] Inventor: Nigel George Moore, Cambridgeshire, United Kingdom

[73] Assignee: Domino Printing Sciences PLC, United Kingdom

[21] Appl. No.: 09/143,323

[22] Filed: Aug. 28, 1998

[30] Foreign Application Priority Data

Sep. 16, 1997 [GB] United Kingdom ..... 9719705

[51] Int. Cl.[7] ..... B41J 2/165

[52] U.S. Cl. ..... 347/28

[58] Field of Search ..... 347/28, 30

[56] References Cited

U.S. PATENT DOCUMENTS 4,296,418 10/1981 Yamazaki et al. ..... 347/28
4,947,191 8/1990 Mozawa et al. ..... 347/30

FOREIGN PATENT DOCUMENTS 2 236 712 4/1991 United Kingdom ..... 347/28
WO 93/17867 9/1993 WIPO ..... 347/28

*Primary Examiner*—N. Le
*Assistant Examiner*—Shih-wen Hsieh
*Attorney, Agent, or Firm*—Robert F I Conte; Lee, Mann, Smith, McWilliams, Sweeney & Ohlson

[57] ABSTRACT

A method of and apparatus for flushing a printhead of a continuous ink jet printer is disclosed, in which the printer has a feed line to which ink is normally fed in use. A gutter line is also provided through which unused ink is removed from the printhead. A bleed line is connected to the printhead for bleeding ink from the printhead, and a flushing line is connected to the printhead through which line flushing fluid is selectively caused to flow through the flushing line to the printhead and from the printhead through the bleed line.

9 Claims, 2 Drawing Sheets

INK JET PRINTER

The present invention relates to ink jet printers and, more particularly, to so-called continuous ink jet printers in which one or more streams of ink droplets are selectively charged and deflected to a print position on a substrate. Many such systems are known, see for example, EP-A-0206614, EP-A-0482123 and EP-A-0522088.

Satisfactory operation of such ink jet printers requires, amongst other things, the maintenance of a substantially constant ink viscosity and this is generally achieved by supplying additional solvent to the ink during use, in accordance with the measured viscosity of the ink. In addition, however, solvent is also used to flush the printhead when printing ceases, in order that ink residues within the head are removed, thus avoiding problems when printing is re-started. In the Domino range of printers for example a separate solvent flushing system is provided so that, on shut-down, solvent is fed into the printhead in place of ink, passing through the printhead and into the conventional gutter in order to clean it.

Other mechanisms for solvent flushing are known and, for example, GB-A-2236712 proposes applying suction to the ink feed line which normally conveys ink to the printhead so as to suck solvent into the ink feed line for delivery to the printhead.

The various known systems are relatively complex in valve requirements and operation and there is a need for a simplified system.

According to the present invention there is provided a continuous ink jet printer having a printhead through which ink is normally fed in use through a feed line and from which unused ink is removed through a gutter line, the printer further including a bleed line for bleeding ink from the printhead, a flushing line connected to a source of flushing fluid, and means for selectively causing flushing fluid to flow through the flushing line to the printhead and from the printhead through the bleed line. Preferably, the means for selectively causing flushing fluid to flow through the flushing line to the printhead and from the printhead through the bleed line comprises a valve means and means for creating a negative pressure in the bleed line. The means for creating negative pressure in the bleed line preferably comprises a jet pump to which a primary fluid supply of pressurised ink is fed in-order to entrain a secondary fluid supply of solvent.

The invention also includes a method of flushing a printhead using the apparatus defined above.

In normal operation, when it is required to adjust the viscosity of the ink, solvent is withdrawn from a reservoir through a control valve and fed to the ink reservoir via the gutter line for mixing therein. To measure the viscosity, valves are operated so that the jet pump flow is fed to a viscometer before being fed back to an ink reservoir from which ink is withdrawn for supply to the printhead. A valve can be used to connect the bleed line to the jet pump so that an alternative secondary flow to the jet pump is provided through the bleed line and a further valve in the flush line connected to the solvent reservoir.

One example of a continuous ink jet printer according to the present invention will now be described with reference to the accompanying drawings in which.

Figure 1:
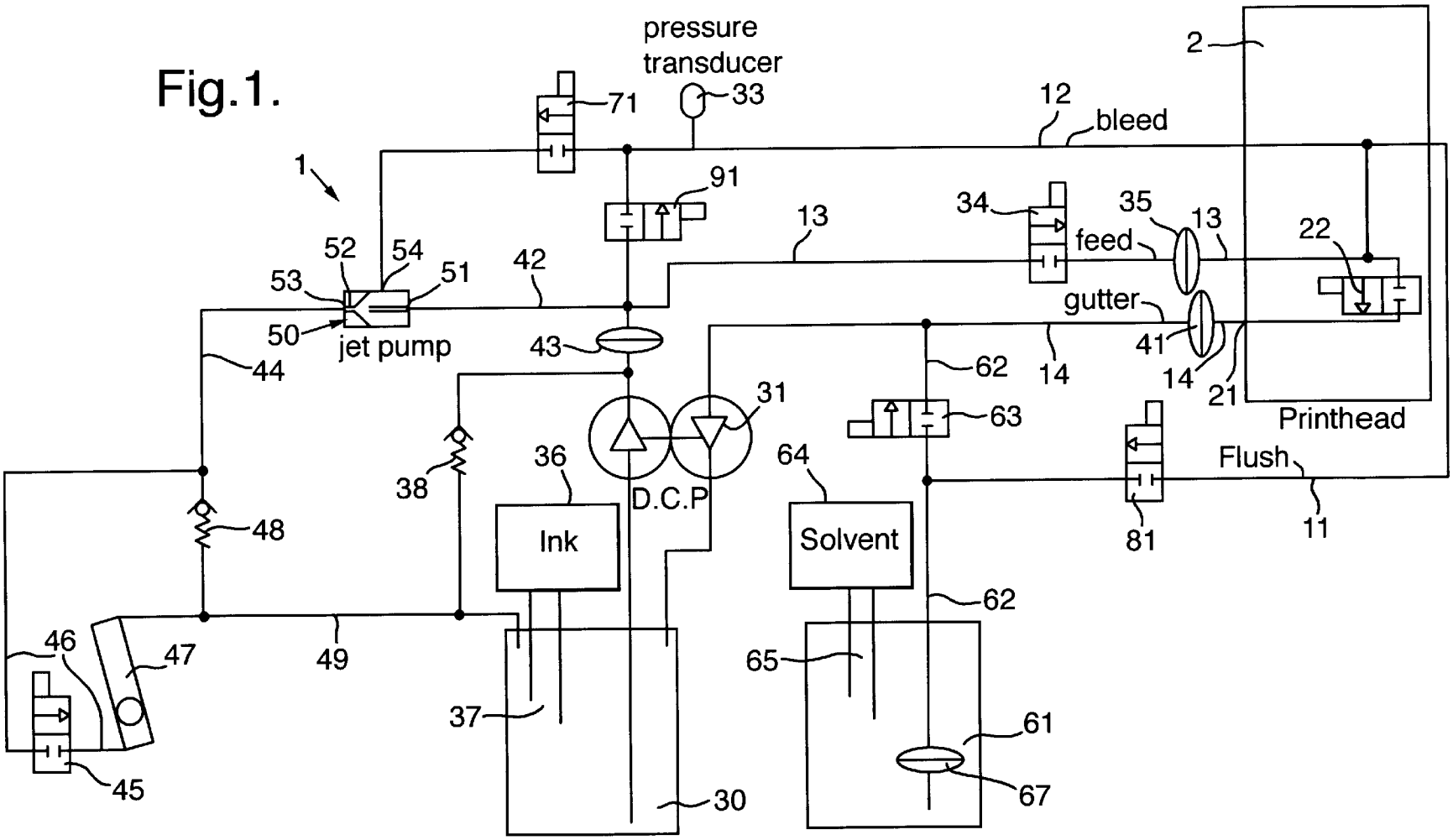
FIG. 1 is a circuit diagram of the ink system of the printer.
Figure 2:
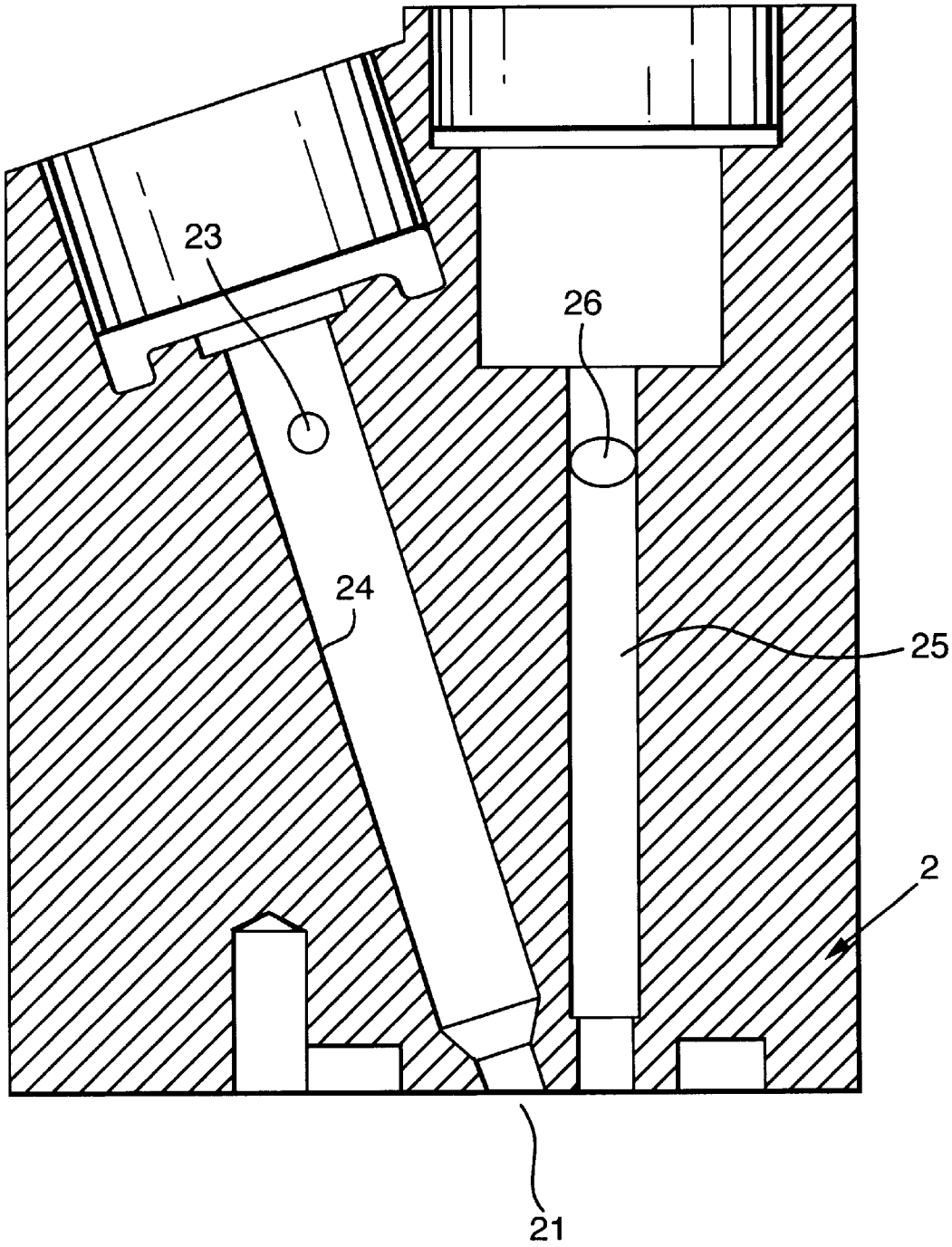
FIG. 2 is a cross-sectional view through part of the printhead.

The printhead 2 of the printer has a nozzle 21 to which ink is fed from a feed line port 23 around the sides of the piezoelectric drive rod (not shown) which fits in the bore 24. The actuator (not shown in FIG. 2) of a printhead valve 22 (solenoid-operated) slides in a second bore 25 to open and close the nozzle 21. A bleed line port 26 allows ink to be bled from the printhead.

The ink system 1 of the exemplified printer of the present invention includes flow lines 11–14 which are connected a to the printhead 2 to provide, respectively, a flush line, a bleed line, a feed line and a gutter line. The solenoid-operated valve 22 which controls the flow of ink, in use, from the feed line 13 to the nozzle 21.

In normal operation ink is withdrawn from an ink reservoir 30 by means of one side of a dual circuit pump 31 and is passed along the feed line 13. Along the feed line 13 is positioned a solenoid-operated feed valve 34. The bleed line 12 has a pressure transducer 33 associated with it to measure the pressure of ink at the printhead (the bleed line is a static line and there is thus no pressure drop between the printhead 2 and the transducer 33). The ink passes into the printhead through a filter 35 and thence through the valve 22 and the nozzle 21. Ink droplets which are not used for printing are directed to the gutter line 14 and pass through a filter 41 and then back through the other side of the dual circuit pump 31 to the reservoir 30.

A replaceable ink cartridge 36 provides, via a dip tube system 37, for topping up of the reservoir 30. As well as passing ink into the feed line 13, the dual circuit pump 31 also supplies ink to a line 42, through a filter 43, to a jet pump 50. The flow line 42 is connected to the primary inlet 51 of the jet pump 50 which provides, through an orifice 52, a flow of primary or entraining ink to an outlet 53. The outlet 53 provides ink into a flow line 44 from which it is fed selectively on operation of a solenoid-operated valve 45, either through a flow line 46 to a viscometer 47 or else through a pressure release valve 48, to a return line 49 into the reservoir 30. A pressure relief valve 38 provides over-pressure protection against high pressure in the output from the pump 31.

For flushing purposes, the primary flow of ink through the jet pump 50 is used to entrain a flow of solvent which acts as a flushing fluid, the solvent being supplied through a secondary port 54 in the conventional manner of a jet pump. Solvent is supplied to the inlet 54 from a solvent reservoir 61 via the flush line 11 and a solenoid-operated solvent flush valve 81, into the printhead, through the bleed line 12, and a solenoid operated bleed valve 71. A renewable solvent cartridge 64 maintains the level of solvent in the reservoir 61 via a dip tube system 65. In use, additional solvent is supplied as necessary depending upon the viscosity determined in the viscometer 47, by selective operation of the valve 63, the added solvent being mixed with the ink flow through the gutter line 14 and passed back to the reservoir 30.

The bleed line 12 joins to the jet pump 50 through a solenoid-operated bleed valve 71 which, in normal use remains closed. The solenoid-operated flush valve 81 connects the flush line 11 to the solvent reservoir 61 and is also closed during normal operation. A solenoid operated secondary flush valve 91 connects the outlet of the dual circuit pump 31 with the bleed line between the bleed valve 71 and the printhead 2. This again is normally closed during operation of the printer.

At shut-down of the printer, and as described above, solvent is flushed through the printhead to remove residual ink and this is achieved as follows. First, the printhead valve 22 is closed so that ink is no longer supplied to the nozzle 21. Ink continues to circulate from the reservoir 30 through the pump 31, via the jet pump 50 and the return line 49. The feed valve 34 is then closed and the flush valve 81 and bleed valve 71 are opened so that solvent from the reservoir 61 can be drawn, via a filter 67, under the negative pressure provided by the jet pump 50 in the bleed line 12, through the flush line 11, the printhead 2 and the bleed line 12. Once solvent has passed into the printhead 2 and into the bleed line 12 then the flush valve 81 and bleed valve 71 are closed. The secondary flush valve 91 is opened briefly to pressurise the printhead and then the printhead valve 22 is also opened so that ink supplied to the bleed line 12 through the secondary flush valve 91 pushes solvent in the bleed line through the printhead valve 22 and out through the nozzle 21. Thus, solvent is flushed through all the necessary parts of the printhead 2. The printer can then be shut down until required again.

The flush valve 81 and the printhead valve 22 may be pulsed open and closed during the flushing procedure in order to reduce the amount of solvent used.

The jet pump 50 acts to provide a source of negative pressure to draw solvent through the flush line 11 and into the bleed line 12, avoiding the need for a separate flushing pump and the arrangement also improves the cleaning of the gun body. Furthermore, the vacuum produced by the jet pump enables the gutter vacuum to be maintained during the flushing procedure which, in turn, eliminates the possibility of ink running out of the gutter as the printer is shut down.

Pressurising the secondary flush valve 91 produces a weaker dilution of ink and solvent to be passed through the nozzle, due to the fact that the bleed line is used to return the flushed fluid to the ink reservoir 30 during cleaning, thus improving the cleaning of the nozzle.

What is claimed is:

1. A continuous ink jet printer having a printhead with four lines extending to said printhead comprising:

a first line being a feed line extending to the printhead through which ink is normally fed in use to said printhead;

a second line being a gutter line extending from said printhead through which unused ink is removed from said printhead;

a third line being a bleed line extending to the printhead for bleeding ink from the printhead;

a fourth line being a flushing line extending to the printhead and in use to a source of flushing fluid; and, means for selectively causing flushing fluid to flow through the flushing line to the printhead and from the printhead through the bleed line.

2. A printer according to claim 1, wherein the means for selectively causing flushing fluid to flow through the flushing line to the printhead and from the printhead through the bleed line comprises a valve means and means for creating a negative pressure in the bleed line.

3. A printer according to claim 2, wherein the means for creating negative pressure in the bleed line comprises a jet pump to which a primary fluid supply of pressurised ink is fed in use in order to entrain the flushing fluid from the printhead as a secondary supply of the pump.

4. A method of flushing a continuous ink jet printer having a printhead through which ink is normally fed in use, the printer having a first feed line extending to the printhead through which ink is normally fed in use to the printhead;

a second gutter line extending from said printhead through which unused ink is removed from the printhead;

a third bleed line extending to the printhead for bleeding ink from the printhead; and a fourth flushing line, extending to the printhead and in use to a source of flushing fluid, comprising:

selectively causing flushing fluid to flow through the flushing line directly to the printhead and from the printhead through the bleed line.

5. A method according to claim 4, wherein the flushing fluid is solvent normally added to the ink to control its viscosity.

6. A method according to claim 4, wherein the flushing fluid is selectively caused to flow through the flushing line to the printhead and from the printhead through the bleed line via a valve means and by creating a negative pressure in the bleed line.

7. A method according to claim 6, wherein the negative pressure in the bleed line is created by passing the flushing fluid from the printhead as a secondary supply of a jet pump to which a primary fluid supply of pressurised ink is fed in use in order to entrain the flushing fluid.

8. A method according to claim 4, comprising the following steps:

a) closing a printhead valve so that ink is no longer supplied to the nozzle of the printhead;

b) continuing to circulate ink from an ink reservoir through a pump;

c) closing a feed valve and opening a flush valve and a bleed valve so that solvent from a solvent reservoir is drawn by negative pressure through the flush line, the printhead and the bleed line;

d) closing the flush valve and bleed valve once solvent has passed into the printhead and into the bleed line;

e) opening briefly a secondary flush valve to pressurise the printhead; and then f) opening the printhead valve so that ink supplied to the bleed line through the secondary flush valve pushes solvent in the bleed line through the printhead valve and out through the nozzle.

9. A method of operating a continuous ink jet printer which includes flushing the printhead according to claim 4.

* * * * *